US007932475B2

(12) United States Patent
Schnodt

(10) Patent No.: US 7,932,475 B2
(45) Date of Patent: Apr. 26, 2011

(54) ELECTRIC SWITCH

(75) Inventor: Wilhelm Schnodt, Auerbach (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 12/595,096

(22) PCT Filed: Apr. 11, 2008

(86) PCT No.: PCT/EP2008/054440
§ 371 (c)(1),
(2), (4) Date: Oct. 8, 2009

(87) PCT Pub. No.: WO2008/125636
PCT Pub. Date: Oct. 23, 2008

(65) Prior Publication Data

US 2010/0084250 A1 Apr. 8, 2010

(30) Foreign Application Priority Data

Apr. 12, 2007 (DE) ..... 10 2007 017 366

(51) Int. Cl.
*H01H 5/18* (2006.01)

(52) U.S. Cl. ..... 200/461

(58) Field of Classification Search ..... 200/461, 200/456, 452, 16 R–16 D, 402, 405, 407, 200/408, 424, 431, 433–435, 437–442, 449, 200/453–463, 467–468
See application file for complete search history.

(56) References Cited

U.S. PATENT DOCUMENTS

| | | | | |
|---|---|---|---|---|
| 3,030,466 | A | 4/1962 | Kryder | |
| 3,194,933 | A | 7/1965 | Ramstetter | |
| 3,336,449 | A | 8/1967 | Ashman | |
| 3,548,132 | A | 12/1970 | Krieger | |
| 3,578,926 | A | 5/1971 | Obermann | |
| 3,997,745 | A | 12/1976 | Marquardt et al. | |
| 4,130,747 | A | 12/1978 | Resh | |
| 4,253,001 | A | 2/1981 | Momozhane | |
| 5,111,010 | A * | 5/1992 | Kokubu et al. | 200/461 |
| 5,870,013 | A | 2/1999 | Van Der Grijn et al. | |
| 5,913,415 | A | 6/1999 | Kishi et al. | |
| 6,847,000 | B1 * | 1/2005 | Marchini et al. | 200/402 |

FOREIGN PATENT DOCUMENTS

| | | |
|---|---|---|
| DE | 937 712 | 12/1955 |
| DE | 1 034 741 | 7/1958 |
| DE | 1 829 460 U | 4/1961 |
| DE | 1 168 993 | 4/1964 |
| DE | 1 166 322 | 6/1964 |
| DE | 1 917 411 U | 6/1965 |
| DE | 1 980 790 U | 3/1968 |
| DE | 1 989 468 U | 7/1968 |
| DE | 23 60 168 A1 | 6/1975 |

(Continued)

*Primary Examiner* — Edwin A. Leon
(74) *Attorney, Agent, or Firm* — Davis & Bujold, P.L.L.C.

(57) ABSTRACT

An electric switch with flexible, fork-shaped contactor having an end area with first and second contact points. At least one tension strip and at least one arched section extends from the contactor in such manner that changing the switch from a normal position, in which the first contact point is in contact with a first contact surface, to a switched position, in which the second contact point is in contact with a second contact surface, and vice-versa, takes place by deformation of the tension strip while an angle formed at the transition, between the arched section and the end area of the contactor, remains substantially unchanged.

15 Claims, 5 Drawing Sheets

Fig. 4a

FOREIGN PATENT DOCUMENTS

| | | | |
|---|---|---|---|
| DE | 29 28 214 | A1 | 1/1980 |
| DE | 195 37 418 | A1 | 4/1996 |
| DE | 296 15 991 | U1 | 3/1998 |
| DE | 197 45 803 | C1 | 7/1999 |
| DE | 103 22 224 | A1 | 12/2004 |
| DE | 10 2005 018 144 | A1 | 12/2005 |
| EP | 0 321 392 | A1 | 6/1989 |
| EP | 0 837 483 | A2 | 4/1998 |

* cited by examiner

ELECTRIC SWITCH

This application is a National Stage completion of PCT/EP2008/054440 filed Apr. 11, 2008, which claims priority from German patent application Ser. No. 10 2007 017 366.2 filed Apr. 12, 2007.

FIELD OF THE INVENTION

The invention concerns an electric switch with an elastically deformable contactor which can be moved against spring force from a normal position to a switched position, whereby a connection of the contactor changes from a first to a second selective terminal. A switch of this type is mentioned for example in EP 0 837 483 A2 as the state of the prior art, and is illustrated in FIG. 24 of that document.

BACKGROUND OF THE INVENTION

In this known switch a contact terminal common to both switch conditions in a holder, an elastically deformable contactor, an actuating element, a first and a second selective terminal, and a lever are arranged in a housing. The elastically deformable contactor comprises an essentially elongated tension strip and an arched area which, seen from above, is arranged parallel to the tension strip. The contactor also comprises an area that connects the tension strip and the arched area, which has a contact point arranged on each side of the arch. By means of an actuator which can be operated from outside, the elastic contactor is deformed elastically from a normal position in which it is in contact with to a first selective terminal, in such manner that the contactor is brought into contact with a second selective terminal. When the actuator is released, the elastically deformable contactor is relaxed, at least partially, and returns to its normal position, so that the actuator too returns to its initial position.

Switches of this type are inter alia made in the miniature or sub-miniature range and fulfill switching tasks in which a normally closed electric contact is temporarily interrupted by mechanical action upon the actuator or a connection to a second contact is made, which is maintained for as long as the actuator is in the switching position. In other applications, however, the actuator or the contactor can be fixed in place.

Switches of this type are particularly suitable for position-detection purposes in automatic processes. Typical fields of application, however, can also be closing systems, vehicle body and inside areas, and various position tests in household appliances or other mechanisms.

DE 1 989 468 indicates to those familiar with the field that relative movement between the contact points which is substantially perpendicular to the switching direction is advantageous, because the contact points remain free from wear or dirt particles. The relative movement in the switch is produced by longitudinal extension of a central spring/switching spring divided into two zones. In this case a rigid zone of the switching spring is moved through an angle, which for its part is deflected by an actuating spring, in the longitudinal direction of the switch. During this extension of the switching spring the lower, meander-shaped part of the switching spring is deformed elastically. This happens because the actuating spring is deflected about the common attachment point with the switching spring in the housing, whereby the switching spring is restricted in its freedom of movement by the two contacts. Consequently, during a deflection movement of the actuating spring beyond the abutment point of the switching spring, relative movement between the actuating spring and the switching spring takes place in the longitudinal direction of the actuating spring, in such manner that the contact point on the touch-zone is moved parallel to the respective contact plane. This elaborate mechanism not only has the disadvantage that three components are needed in order to produce relative movement between the contacts, but the added disadvantage that for the linear movement of the switching spring to be produced, a large rotational deflection of the actuating spring is needed, which in turn leads to a switch of large structure.

The explanatory document DE 1 168 993 also concerns an electric snap-action switch whose purpose is to design the frictional and rolling movements of the contact elements more robustly. In this case a rigid contact arm which is hinge-mounted at its end remote from the contact points is moved one way or the other between two contact terminals by a switching arm. For its part, the switching arm is deflected at one end by an actuating element. The other end of the switching arm is hinge-mounted on a common terminal. To provide support against a first contact in the normal position of the switch there is a C-shaped spring, which when the actuating element is operated, becomes more tightly curved. As a whole the articulated holding of the rigid contact arm and the circular deflection of the switching arm result in an only very small linear movement of the contact point of the rigid contact arm on the contact point of the terminal. Here too, no linear movement of the contact point of the contact arm on the contact surface of the terminal takes place.

DE 1 917 411 U, which is the point of departure of the most closely related prior art, describes an electric switch with a one-piece, elastically deformable contactor configured in three zones: a leaf-spring zone which is flat in any switch condition, a compression spring blade zone, and a free end zone. A first and a second contact point are arranged on the opposite faces of the leaf-spring/switching spring zone. From the switching spring zone there extends a compression spring blade, which rests against a knife-edge support. The free end zone is bent over by about 180° relative to the switching spring and rests against a projection on the housing. When the switch is changed from a normal position, in which the switching spring is touching an upper contact, to a switched position in which the switching spring is touching a lower contact, the curvature of the compression spring blade increases while at the same time the leaf-spring zone (without undergoing any deformation) is moved by the actuating element in the direction of the switch-over point. When the switch-over point has been passed, the switching spring snaps over from the upper contact to the lower contact.

Due to the curvature change of the compression spring blade, until the switch-over point has been reached a slight frictional movement on the connection element (contact) takes place between the switching spring and the contact point of the upper connection element. It has been found that the smaller the structure of the switch, and the shorter that the switching path of the switch is chosen, the smaller is the frictional movement of the switching spring on the respective contact elements.

In the switch known from the prior art as described in EP 0 837 483 A2, a spring mechanism for the contactor is known, which is responsible for switching from a first contact point to a second contact point. In this, in particular the distance between the two selective terminals and the spring strength of the leaf spring are important influencing parameters. Thus, for the known switch it is advantageous to use a relatively strong leaf spring in the arched section, in order to ensure secure contact forces on the first and second contact points. By using so strong a leaf spring the actuation forces for such a spring are also necessarily increased and the tension strip must accordingly be made with the highest possible bend rigidity.

The result of supporting the curved zone with its free end against the common contact terminal is that the contactor is pushed upward, so that contact against the first contact point produces a torque such that the free end of the tension strip, which is attached to the lever, pushes the lever together with the actuating element to the initial position. When the actuating element is moved into the housing, the free end of the tension strip moves over the support point of the arched section, and when this is reached an equilibrium is established such that further movement of the free end of the tension strip triggers linear movement of the end area of the contactor from the first contact point to the second contact point. However, before the contactor moves clear of the first contact point, i.e. before the tension strip reaches the support point of the arched section, linear movement takes place on the first contact point in the longitudinal direction of the tension strip. This happens because the tension strip on the lever, which is attached to and can pivot in the housing, undergoes a circular-arc movement about the pivot point of the lever. At the same time the end area of the contactor is impeded in its movement toward the contact surface by the touch-point of the contact point and therefore completes only that part of the tension strip's movement which is directed in the longitudinal direction of the switch.

Once the switch-over point has been passed, i.e. when the tension strip has moved past the support point of the arched section, the end area changes over from the first contact point to the second contact point. This happens by virtue of an approximately linear movement directed perpendicularly to the tension strip and by a substantially parallel displacement of the contactor in the actuating direction of the actuating element. After the switch-over, as the tension strip moves farther the second contact point of the contactor undergoes an additional curved movement whereby the second contact point rolls on its contact area in the same rotation direction as the curved motion of the tension strip. Accordingly, on the second contact point there is a greatly reduced linear movement or a greatly reduced sliding or rubbing of the contact point over the contact surface in the longitudinal direction of the switch. Under certain geometrical conditions the linear movement of the contact points on the contact surfaces tends toward zero.

In order to be able to switch reliably between the two contact positions even with the often required small actuating forces, at both contact points a linear movement should take place in or against the tension direction of the tension strip, i.e. essentially in the longitudinal direction of the holder or the housing. Such a linear movement on the individual contact surfaces keeps them clean and larger loads can be switched with the same contact pressure than when no such linear movement takes place.

For the known electric switch this means that on the first selective terminal a higher load can be connected than on the second one. Thus, with the known switch the second contact point determines the load that can be connected by the electric switch.

Short current and voltage peaks, for example occurring when capacitative or inductive loads are connected, can result in welding together of the contacts. Thanks to the linear frictional movement of the contact surfaces relative to one another, such welds between contacts are immediately broken again during the actuation of the switch. Thus, the shorter the linear rubbing travel the more probable it is that contact welding will occur. In the known switch, at the second contact point, owing to the rotation movement of the contactor the linear rubbing movement changes to a pure rolling of the contact point on the contact surface. Contamination or particles deposit on the contact surfaces over the life of the switch, and lead to welds between the contact points and the contact surfaces.

In the case of more severe contamination or larger particles, such rolling can lead to failure of the switch since such particles cannot be cleared away from the contact surfaces by the rubbing movement of the contact points.

SUMMARY OF THE INVENTION

The purpose of the present invention is to provide an electric switch with a spring mechanism, in which a sufficient linear movement takes place both on a first contact surface and on a second contact surface, so that the drawbacks of the prior art are avoided. The structure of the switch should be simple, easy to produce and simple to assemble, and reliable operation with a long service life should be ensured.

As in the prior art, the elastically deformable contactor of the switch according to the invention can be moved in such manner that the contactor with its contact points is in electrically conducting or non-conducting connection, alternately, with two contact surfaces of selective terminals. A more flexible structure of the tension strip compared with the arched section ensures that when the lever, to which the tension spring is attached, is moved, the tension spring is deformed and an end area of the contactor, in its angled position relative to the arched section of the contactor, remains almost unchanged. By maintaining the angle between the arched section and the end area, it is ensured that no rotational movement takes place between the contact point and the contact surface around the touch-point where the contact touches the contact surface. At the same time, owing to the forced curved movement of the tension strip, the contact point is compelled to undergo linear movement over the contact surface in the longitudinal direction of the holder, since the contact of the end area against a contact surface prevents any movement in the direction normal to the contact surface.

In this context, the longitudinal direction of the switch is understood to be the main extension direction of the tension strip in the normal position of the switch. Regardless of the position in which the switch according to the invention is fitted, this direction should also be understood as the 'horizontal' direction of the switch. The 'vertical' direction of the switch is defined by the distance between the two contact surfaces, and 'upper' or 'top' indicates that side of the contactor in which the actuating element is located in the normal position.

Owing to the constancy or only slight or minimal change of the angle between the end area of the contactor and the arched section of the contactor, rotation of the contact points on the contact surfaces about the touch-point of the contact points is avoided. Thus, a linear movement in the longitudinal direction of the holder takes place on the second contact surface as well, and impurities or particles can be cleared away from it effectively. Even welding of the contact points to the contact surfaces can best be prevented in this way. If welds still occur, these can be broken by the forces acting in the longitudinal direction of the switch.

Preferably, the contactor is designed so that it has two arched sections a distance apart from one another, between which is arranged a tension strip designed in such manner that it can be deformed elastically without changing the angle between the arched sections and the end area. Seen from above, the two arched sections are in essence parallel to the flexible tension strip. The end area of the contactor connects the two arched sections on one side or at one end, and one end of the tension strip. Thus, seen from above the contactor looks rather like a fork which has at least two projections or prongs, with at least one projection forming the tension strip and one projection the arched section. In the assembled condition the end of the arched section is supported on a common contact terminal needed in both switch conditions for the passage of an electric signal. The end of the tension strip is attached to an end area of the pivot-mounted lever. When the pivot-mounted lever is deflected by the actuating element, in essence only the tension strip is deformed, its deformation remaining in the elastic range. At the same time the attachment point of the tension strip to the end of the lever undergoes curved movement. Due to the necessarily curved movement of the attachment or connection point between the tension strip and the lever, and the simultaneous support of the end area by the contact points on the contact surfaces, a force is produced in the longitudinal direction of the switch, which moves the contact points over the contact surfaces approximately horizontally. Owing to the relatively rigid connection, compared with the tension strip, between the arched section of the contactor and its end area, when the lever is deflected the angle in the transition zone between the arched section and the end area does not change.

In another embodiment only one arched section is provided on the contactor, which, seen from above, is arranged centrally between the webs of the tension strip. In this case the arched section is made firm enough so that when the lateral tension strip areas are deformed, there is no change of the angle between the arched and end areas. The free end of the arched section is again supported on the common contact terminal and the two tension strip sections are connected to one another at the end remote from the end area and attached to the lever. In this embodiment too, when the lever or connection point of the tension strip to the lever is deflected, essentially only the tension strip or its sections arranged laterally alongside the arched section are deformed. At the same time as the deformation of the tension strip, the curvature of the arched section is elastically deformed, but the angle, which in a strict mathematical sense is enclosed between a tangent to the arched section at the bend line between the arched section and the end area and the end area itself, does not change substantially during the movement of the attachment point of the tension strip. By virtue of the support of the contact points on the respective contact surfaces of the selective terminals, the curved movement undergone by the attachment point of the tension strip to the lever is compelled to follow a linear course in the longitudinal direction of the holder or switch. This happens both at the first contact surface, where the electric switch is in its normal position, and at the second contact surface, when the electric switch is in the switched position.

Thanks to the linear movements of the contact points on the contact surfaces, compelled to take place in accordance with the invention both on the first selective terminal and on the second one, interfering foreign layers are mechanically removed. The rubbing movement of the contact points on the contact surfaces is also important if the switch has to be operated under unfavorable environmental conditions and, for example, oxide layers, silicate layers or other undesired deposits are formed on the contact surfaces. By virtue of the simple design of the contactor according to the invention, the contact surfaces and contact points in the electric switch with its spring mechanism according to the invention have a self-cleaning action. The rubbing movement on both contact surfaces opposes any welding of the contact points to the contact surfaces. The result is that with the switch according to the invention larger loads can be connected than with the switch of the prior art, having a contact spring/contactor of equal strength.

Thanks to the tension strip that can be deformed in the elastic range without much force, a suitable design of the arched section enables a large contact force to be produced with little force application, i.e. with a low switch actuation force, while at the same time achieving a long friction path, i.e. the length of the rubbing movement on the respective contact surfaces.

As regards the design form, the switch according to the invention is not limited to embodiments such as those known from the above-mentioned prior art; rather, the essential features of the invention are that the arched section of the contactor is connected rigidly to the end area of the contactor and the tension strip is connected flexibly to the end area, i.e. the tension spring can be easily deformed elastically. The tension spring moves the end area of the contactor essentially linearly and parallel to the contact surfaces of the selected contact bodies, with simultaneous overarching of the arched section of the contactor.

According to the invention, in this it is unimportant whether a pivot point of the lever deflected by the actuating element is located in front of or behind the contact area of the contact points and contact surfaces in the longitudinal direction. Preferably however, the contact area of the switch is located between the attachment point of the tension strip to the lever and the pivot point of the lever. With such an arrangement the angular movement of the lever at its pivot point and thus the force loss occurring are reduced to a minimum, and the actuating force is therefore kept as small as possible. The effective lever arm for the pivoting movement of the lever then ranges around its maximum.

Moreover, the result of having a structure of the lever as elongated as possible, i.e. an arrangement of the pivot point and the attachment point on different sides of the contact area, is that despite the high contact forces produced by the arched section and responsible for the necessary contact force, the actuating forces for the switch are kept low by making use of the lever ratios.

Preferably, the actuating element is moved in a linear direction perpendicular to the contact surfaces of the selective terminals and thus deflects the lever in such manner that the connection point at the non pivot-mounted end of the lever describes a circular movement. This circular movement is converted by the supporting of the touch-point of the contact points on the contact surfaces, via the tension strip, to a linear movement of the touch-point of the contact points over the contact surfaces. With an appropriate arrangement of the actuating element the deflection, i.e. the pivoting of the lever can also take place by virtue of a pivoting motion of the actuating element. In this case it is for example conceivable that the actuating element is an extension of the tension strip or of the lever.

Conventionally, the actuating element is moved by pressing from a normal position to a switching position in which the second contact point is in contact with the second contact surface. When the actuating element is released, then owing to the elastic stress in the tension strip and the arched section, the contactor and the actuating element are restored to the normal position by the lever, which is in contact with the actuating element.

In a further embodiment the actuating element can also be arrested in the switching position, for example so that if the actuating element is operated repeatedly, it can be restored to the normal position by partial elastic relaxation of the contactor.

Preferably, the convex side of the arched section of the elastically deformable contactor faces toward the actuating element, i.e. upward. The support point of the arched section is then chosen such that it is supported on the common contact terminal on the side of the flexible tension strip where there is no curvature. Furthermore, the support point of the arched section is located on the common contact terminal a distance away from the tension strip, so that the spring force of the arched section fitted with pre-stress produces a torque in the normal position of the contactor such that the fast contact point on the end area of the contactor is in contact with a first contact surface of the first selective terminal under some pre-stress and the actuating element remains in its initial position.

When the lever to which the tension strip is deflected as far as a point at which the vertical distance between the flexible tension strip and the support point of the arched section on the common contact terminal becomes zero, the first contact point remains in contact with the first contact surface. This is the switch-over point, since at that point the torque which presses the first contact point onto the first contact surface, is also zero because there is no lever arm. Preferably, the switch-over point or the moment when switching occurs is when the actuating element has covered half its path from the normal position to the switch-over position. However, such a design is not strictly necessary.

If the lever is deflected farther and the tension strip moved farther away from the arched section, the end of the contactor is pulled by the tension strip onto the second contact surface. During this the end area undergoes an almost linear, substantially vertical movement and the second contact point is in contact with the second contact surface. In that situation the force exerted on the actuating element deforms the flexible tension strip and moves it in a curved path. At the same time the arched section becomes overarched due to the curved movement of the tension strip.

Due to the overarching of the arched section, the angle enclosed by the arched section and the end area does not change. Instead, the connection point of the end and arched sections remains unchanged with regard to their relative position to one another, and only its position in space changes due to the curved movement path of the tension strip. The more the lever is deflected, which preferably happens by movement perpendicular to the longitudinal direction of the holder, the more markedly is the arched section pulled together by the tension strip and overarched. At the same time the tension strip is elastically deformed farther, such that in its spatial arrangement in the holder it moves in a curved path.

This farther movement of the tension strip in its curved path, and the support or contact of the second contact point on the second contact surface, produce linear movement of the contact point in the longitudinal direction of the end area over the second contact surface.

Particularly during the movement of the flexible tension strip from the switch-over point to the switch position in which the second contact point is in contact with the second contact surface, the virtual invariability of the angle between the arched section and the end area ensures that the end area and the tension strip do not lie in one plane. Owing to the relatively rigid connection between the arched section and the end area, to which the tension strip is also attached, and due to the forced curved path, the end area is moved approximately parallel to the contact surfaces in the direction toward the connection point of the tension strip to the lever. The second contact point then rests with its contact area against the contact surface so that movement perpendicular to the contact surface cannot take place and the contact force can act in that direction.

In the preferred example embodiment the contactor is arranged in the holder in such a manner that its arched section is located on the same side of the tension strip as the actuating element. However a reversed arrangement of the contactor, i.e. with the arched section on the other side, namely under the tension strip, is also possible and in that case, with a suitable choice of the support point of the arched section on the common contact terminal the normal and switched positions are interchanged compared with the embodiment described above. In that case, however, the position of the actuating element in the normal position does not change. But the actuating element can be arranged not only so that the lever is deflected by pressing it, but also by a pulling movement or a turning movement thereof. For those with knowledge of the field, a suitable reversal of the movement sequences or lever ratios and a suitable change of the translational movement of the actuating element to a rotational or curved movement are suitable ways for adapting the switch to the application situation concerned.

Preferably, the contactor is made of only one material. This means, for example, that the arched section, the end area and the flexible tension strip are made from an even, flat strip material by longitudinal cutting and appropriate plastic deformation. The contactor can be made of any electrically conductive material that can be deformed elastically within the movement limits, in particular, of the tension strip. Moreover, the material of the contactor should have sufficient rigidity or strength in the connection area of the arched and end areas to ensure that the angle between the arched and end areas does not change when the tension strip is elastically deformed.

Of course, if a suitable joint is formed between the arched section and the end area—always provided that the angle between the curved and end areas does not substantially change when the arched section and the tension strip are deformed—then the tension strip, the arched section or the end area can each be made of another material. Another possibility for the structure of the contactor is to have an integrally made arched section with an end area angled off it at an angle that does not change, to which a tension strip is attached, for example so that it can pivot, in such manner that it can be joined to the lever and will transfer a tensile force to the end area in the direction of the tension strip, whereby on the one hand the linear movement of the contact points on the contact surfaces is ensured, and on the other hand the contact points can be changed from one contact surface to the other contact surface by deflecting the lever.

Thus, many possibilities are conceivable for the design of the contactor, provided in each case that the invariability of the angle between the curved and the end areas of the contactor when the contactor is deformed elastically, and continuous conductivity from the touch-point of the contactor's contact points and the support point of the arched section on the common contact terminal, are ensured. It is conceivable, however, that one of the two sides of the end area of the contactor does not form a conductive connection with one of the two selective terminals, so that a switch is formed which produces either a conductive connection or a non-conductive connection only: a so-termed on/off switch.

What was already said for the contactor, also applies for the material of the contactor's points, namely that they do not have to be the same as the material of the contactor, and preferably consist of the material of the contact surfaces of the selective terminals.

Furthermore, the contact surfaces on the selective terminals do not have to be made of the same material as the said terminals, any more than the materials of the two selective terminals have to be the same as one another. However, the common contact terminal and the two selective terminals with the contact surfaces—or at any rate at least one selective terminal with a contact surface—must comprise an electrically conductive material to ensure the function of the switch. Preferably however, the material of the contact points is chosen the same as that of the contact surfaces.

Preferably, the actuating element, the common contact terminal, the contactor and the selective terminals are arranged in a housing which is closed by a cover. However, the housing can also be a holder which is substantially unclosed. If the switch is used in moist, out-door areas, then in addition to suitable sealing between the housing and the cover it is preferable for the actuating element, which will be moved, to be additionally sealed relative to the housing or cover, for example by a membrane.

Even though the linear movement of the contact points on the contact surfaces, occurring in accordance with the invention, provides good protection against welding between the contact points and the contact surfaces, this protection can be made even better, or breaking of any welds favored, by rotating the contact points about an axis preferably parallel to the tension strip. Such twisting of the end area relative to the tension strip produces, at the same time as the forced linear movement, also to a type of screwing movement on the contact surface and any welds between the contact points and surfaces can be broken or detached more easily.

BRIEF DESCRIPTION OF THE DRAWINGS

Below, the invention is explained in more detail with reference to example embodiments illustrated in the figures, which show.

DETAILED DESCRIPTION OF THE DRAWINGS

Figure 1:
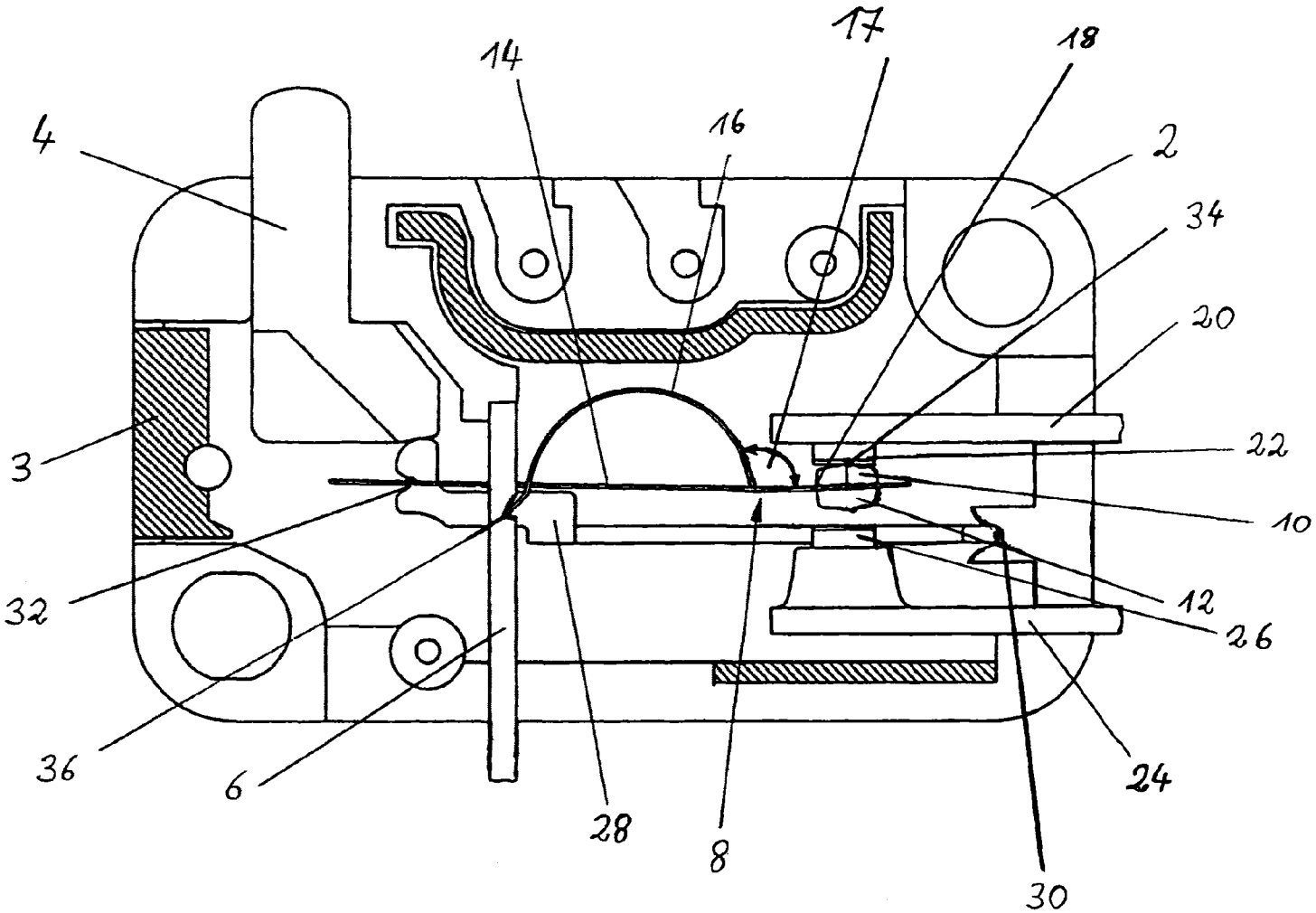
FIG. 1: Sectional view of a preferred embodiment of the switch according to the invention.

FIG. 1 shows a contactor 8 arranged approximately centrally in a holder 2 or a housing 2, which comprises an arched section 16, a tension strip 14 and an end area 18. Between the end area 18 and the arched section 16 is enclosed an angle 17, which remains virtually unchanged during elastic deformation of the contactor.

In the switch according to the invention, shown in FIG. 1 in its normal position, a first contact point 10 in the end area 18 of the contactor 8 is in contact with a first contact surface 22 of a first selective terminal 20 and, by virtue of its touch-point 34, forms a continuous conductive connection through the common contact terminal 6, the contactor 8, the first contact point 10, the touch-point 34, the first contact surface 22 and the first selective terminal 20. In FIG. 1, under and approximately parallel to the contactor 8 or its tension strip 14 there is a lever 28, which is mounted at one end to pivot in the housing 2 at the pivot point 30. The lever 28 is also connected at an attachment point 32 to the tension strip 14 of the contactor. If the lever 28 is pivoted around the pivot point 30 by operating the actuating element 4, the tension strip 14 is moved in a curved path around the pivot point 30.

At the same time the contactor 8 is fixed with the free end of the arched section 16 on the support point 36 on the contact terminal 6 in such manner that the elastic deformation of the arched section 16 by the support point 36, which is located under the tension strip 14, exerts a torque on the contactor 8 so that the touch-point 34 is pressed against the first contact surface 22. Since the arched section 16 is designed essentially stronger compared with the tension strip 14, the torque it produces presses the touch-point 34 more against the first contact surface 22, while the tension strip 14 is forced into a curved path until the tension strip 14 reaches the support point 36. During this only the force component directed in the longitudinal direction of the holder 2 pushes the end area 18 of the contactor 8 in the longitudinal direction of the holder 2, over the contact surface 22.

This means that by virtue of the pivoting movement of the tension strip 14 around the pivot point 30, linear movement of the touch-point 34 over the contact surface 22 is produced.

The arrangement of the two selective terminals 20 and 24 and of the common contact terminal 6, the contactor 8 and the actuating element 4, as illustrated, is only an example embodiment which can be modified in order to fulfill the most varied application conditions of such a switch.

Figure 2:
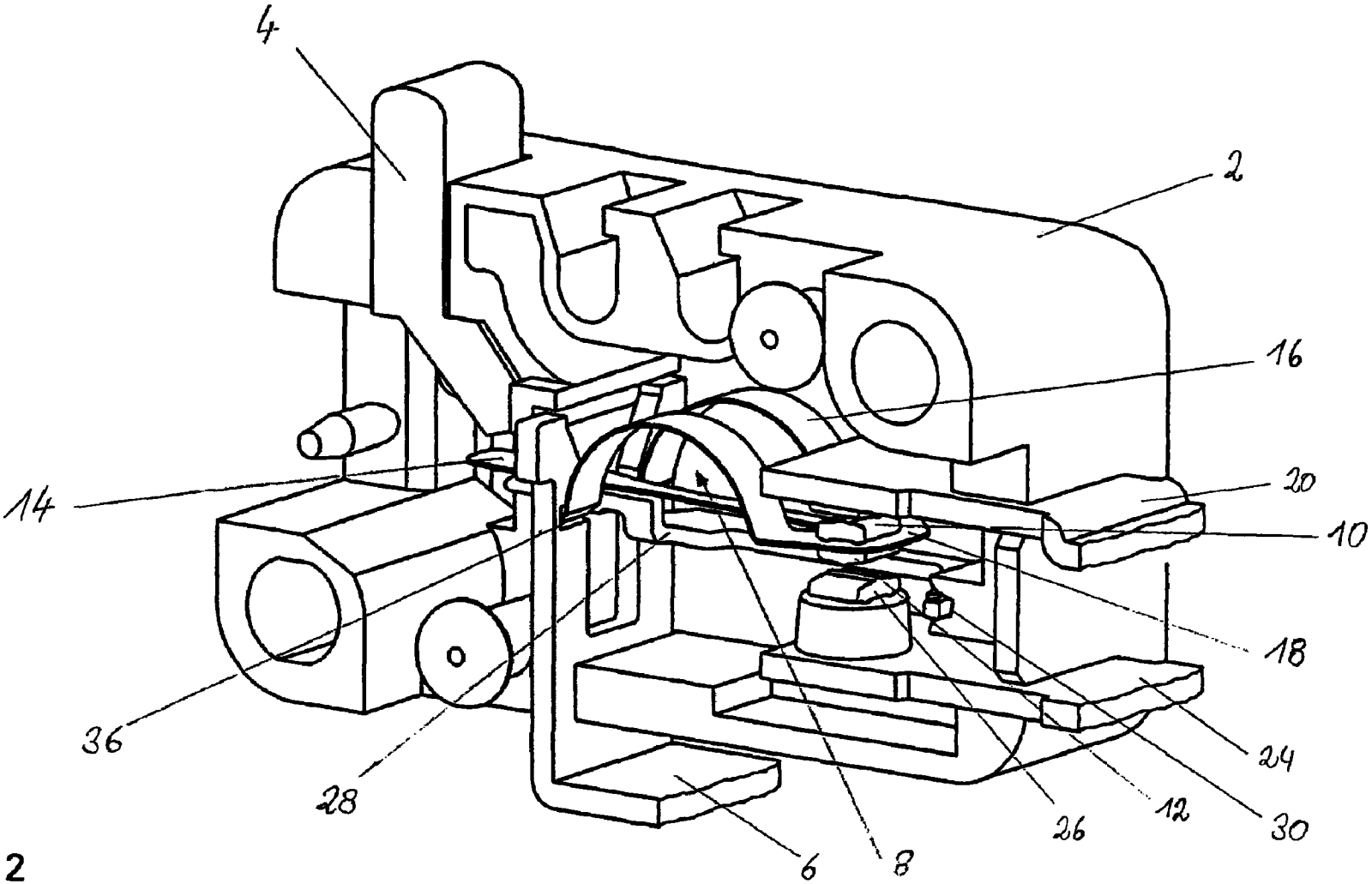
FIG. 2: Perspective view of the switch in FIG. 1.

FIG. 2 shows a perspective view of the switch of FIG. 1. Here it can be seen clearly that the arched section 16 of the contactor 8 is substantially thicker, i.e. stronger than the tension strip 14. Likewise the end area 18 at an angle to the arched section 16 can be seen, which in FIG. 2 is in the normal position, i.e. with the first contact point 10 in conductive contact with the first selective terminal 20. The easy deformability of the tension strip 14 in the elastic range makes it possible, when the contactor is changed from its normal position to the switch-over point and farther on to the switched position, essentially for only the tension strip 14 to be deformed elastically while the radius of curvature decreases and the arched section becomes more markedly curved owing to the linear movement of the end area. FIG. 2 also shows that the angular position between the arched and the end areas is not changed.

Figure 3A:
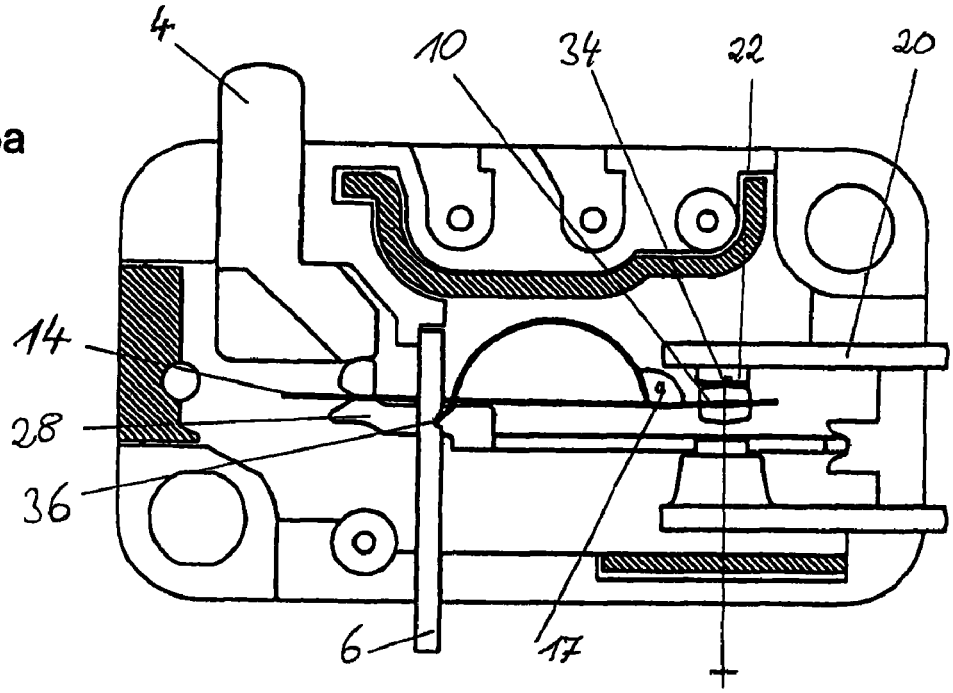
FIGS. 3*a*) to 3*d*): The switch of FIG. 1 shown in its various switch positions.

FIGS. 3*a*) to 3*d*) show the switch of FIG. 1 according to the invention in various positions. FIG. 3*a*) shows the switch in its normal position, in which the first contact point 10 is in conductive contact with the first contact surface 22 on the first selective terminal 20. Owing to the vertical distance of the support point 36 of the arched section on the common contact terminal 6, the arched section 16 produces a torque which presses the contact point 10 against the contact surface 22.

Figure 3B:
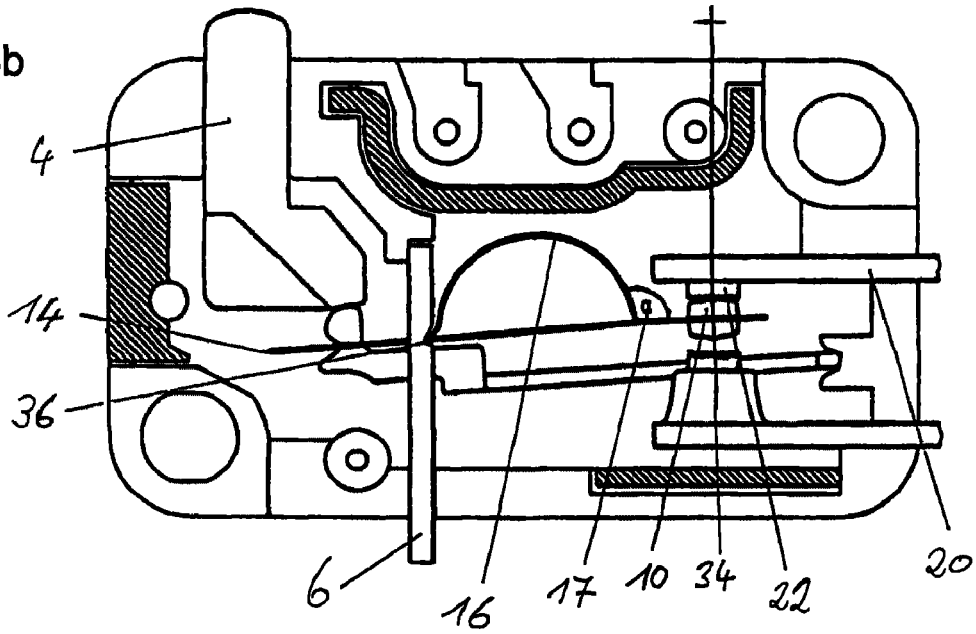

When the actuating element 4 is operated, the lever 28 is first moved to the switch-over point illustrated in FIG. 3*b*). In this position there is no longer any vertical distance between the tension strip 14 and the support point 36, so the torque that presses the contact point 10 against the contact surface 22 is reduced to zero. As can be seen by comparing FIGS. 3*a*) and 3*b*), the deflection of the lever 28 essentially elastically deforms only the tension strip 14. In contrast, the radius of curvature of the arched section 16 has only decreased slightly. However, there is almost no change in the angular position of the end area relative to the lever or relative to the selective terminal 20. Only the horizontal position of the touch-point 34 has been pushed by the linear movement closer to the terminal 6, as can be seen from the distance between the two vertical lines through the touch-point 34 leading downward or upward, respectively in FIGS. 3*a*) and 3*b*). That distance corresponds to the length of the friction path or of the linear movement of the contact point 10 on the contact surface 22.

Figure 3D:
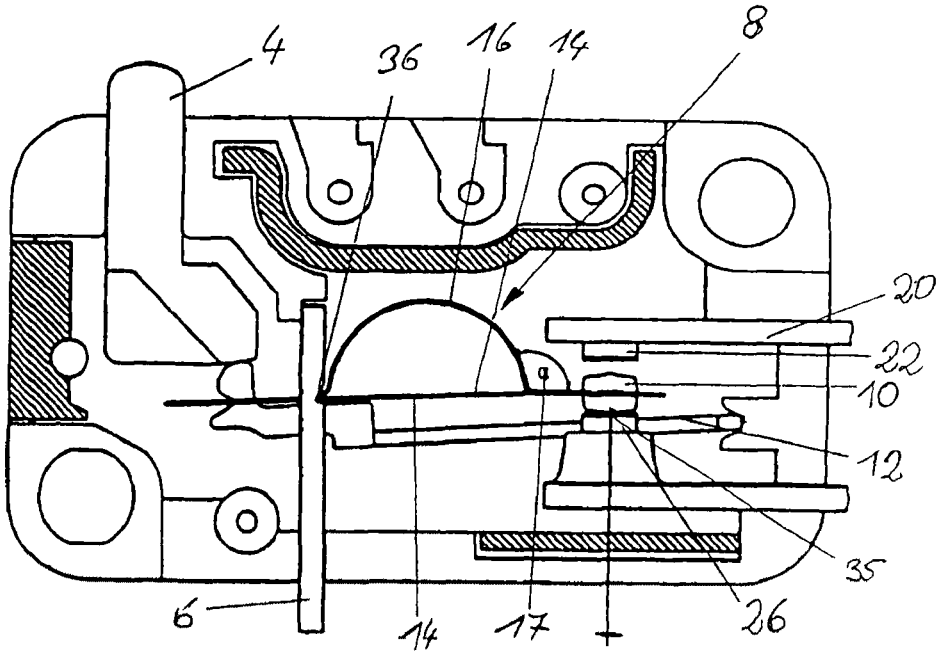
Figure 3C:
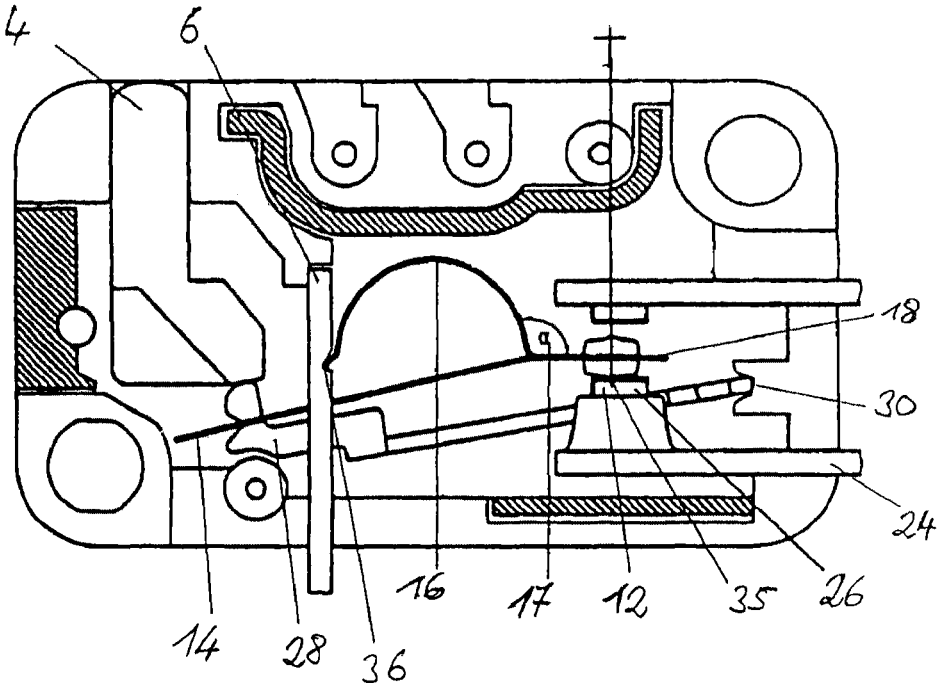

When the lever 28 in FIG. 3*b*) is pressed farther down, at first the vertical movement is transferred directly to the contactor 8 without any further deformation thereof and the contactor closes a conductive connection with the second selective terminal 24 once the end area 18 of the contactor 8 has moved vertically. Now, the second contact point 12 rests, at a second touch-point 35, against the second contact surface 26. With further movement of the actuating element 4 the lever 28 is deflected farther and forces the tension strip 14 farther along a curved path around the pivot point 30 of the lever 28. Since the touch-point 35 cannot follow the curved movement of the tension strip 14 because of its contact against the second contact surface 26, with further deflection of the lever 28 the touch-point 35 moves approximately horizontally over the second contact surface 26 toward the common contact terminal 6. The friction path moved through during this by the touch-point 35 between the switch-over moment, which is also shown in FIG. 3*d*), and the switched position shown in FIG. 3*c*), is made clear by the distance between the two vertical lines leading from the touch-point 35 respectively upward and downward in the two figures, FIGS. 3*c*) and 3*d*). This distance corresponds to the length of the friction path, or linear movement of the contact point 12 over the contact surface 26. The frictional movement improves the self-cleaning of the contact surface 26 and at the same time makes it more difficult for the contact point 12 to become welded to the contact surface 26.

The switch according to the invention is changed from the switched position in FIG. 3*a*) to the switch-over point in FIG. 3*d*) when the pressure on the actuating element 4 is released, since the potential energy stored in the elastically deformable contactor 8 pushes the actuating element 4 upward in the plane of the drawing. When the tension strip moves past the switch-over point, as shown in FIG. 3*d*) in which the tension strip is at the level of the support point 36, further upward movement of the tension strip 14 at the same time moves the end area 18 linearly upward, so that the second contact point 12 is raised clear of the second contact surface 26 and the first contact point 10 again moves into conductive connection with the first contact surface 22.

Further relaxation of the elastically deformed contactor 8 results in further raising of the tension strip 14 and hence to a return of the actuating element 4 to its starting position and of the contactor 8 to its normal position, as shown in FIG. 3*a*). Thus, FIGS. 3*a*) to 3*d*) show a complete switching cycle which, however, is illustrated here only as an example relating to an example embodiment of an electric switch with a spring mechanism.

Figure 4A:
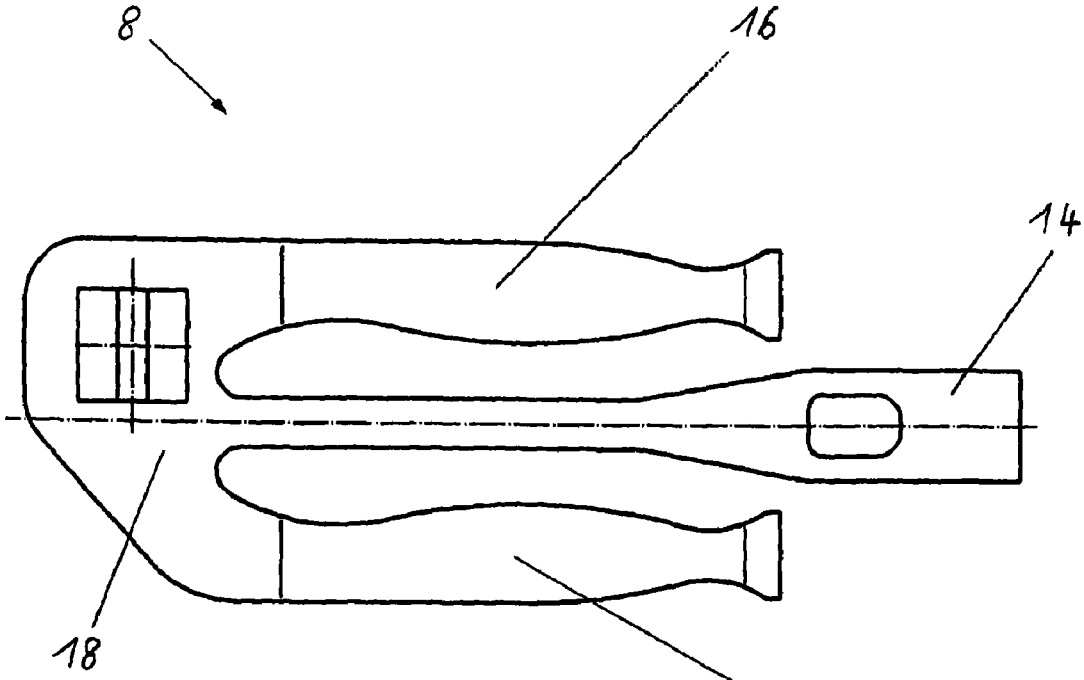
FIGS. 4*a*) and 4*b*): Other embodiments of the contactor.
Figure 4B:
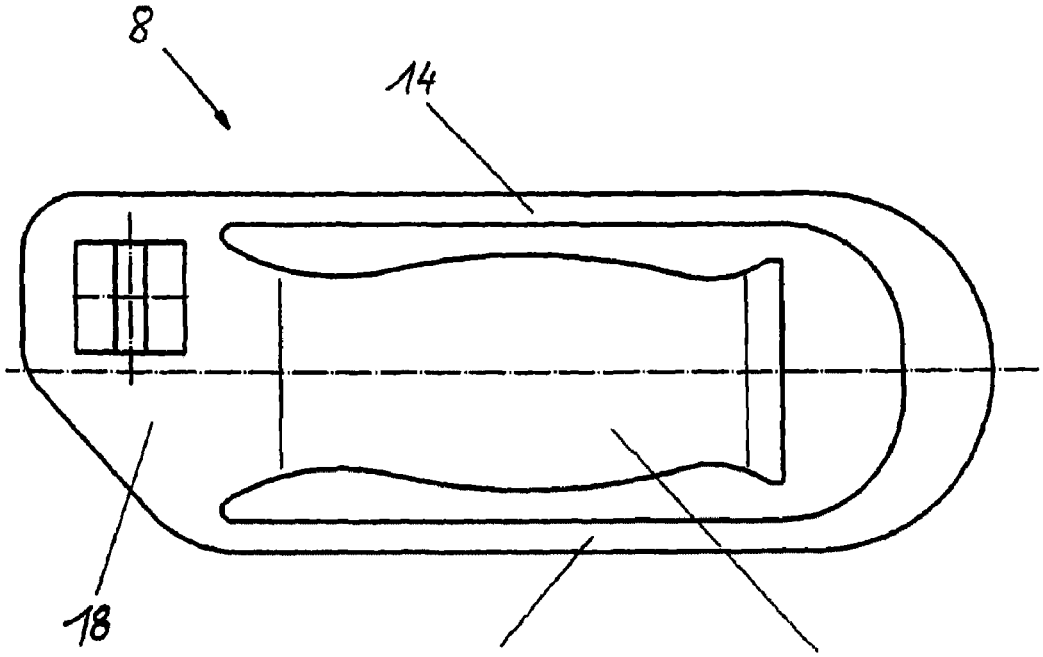

FIGS. 4*a*) and 4*b*) show two embodiments of contactors 8, such that in FIG. 4*a*) the arched section 16 has two arches outside a centrally positioned tension strip 14. The contactor shown in FIG. 4*b*) has a central arched section 16 with respective tension strips 14 running past its outside flanks, these strips being connected to one another at their ends opposite the end area 18.

From the two embodiments in FIGS. 4*a*) and 4*b*) it can be seen clearly that compared with the tension strip(s) 14, the arched section(s) 16 is/are substantially stronger and the connection of the end area 18 to the arched section 16 is strong enough to prevent any substantial change of the angle 17 between the end area 18 and the arched section 16.

LIST OF INDEXES

2 Holder
3 Cover
4 Actuating element
6 Common contact terminal
8 Contactor
10 First contact point
12 Second contact point
14 Tension strip
16 Arched section
17 Angle
18 End area
20 First selective terminal
22 First contact surface
24 Second selective terminal
26 Second contact surface
28 Lever
30 Pivot point
32 Attachment point
34 First touch-point
35 Second touch-point
36 Support point

The invention claimed is:

1. An electric switch comprising a one-piece, elastically deformable fork-shaped contactor (8), the electric switch having an end area (18) on which a first contact point (10) and a second contact point (12) are arranged, and at least one tension strip (14) and at least one arched section (16) extending from the end area (18) such that movement of an actuating element (4) from a normal position, in which the first contact point (10) is in contact with a first contact surface (22), to a switched position, in which the second contact point (12) is in contact with a second contact surface (26), and vice-versa, the tension strip (14) being elastically deformed and an arch of the arched section (16) is elastically deformed by linear displacement of the first and the second contact points (10, 12), respectively, over the first and the second contact surfaces (22, 26); and a lever (28) having first and second end areas, first end area of the lever (28) being mounted to pivot around a pivot point (30), and the tension strip (14) of the contactor (8) being attached adjacent the second end area of the lever (28) that is in contact with the actuating element (4).

2. An electric switch comprising a one-piece, elastically deformable contactor (8), the electric switch comprising an end area (18) on which a first contact point (10) and a second contact point (12) are arranged, and at least one tension strip (14) and at least one arched section (16) extending from the end area (18) such that movement of an actuating element (4) from a normal position, in which the first contact point (10) is in contact with a first contact surface (22), to a switched position, in which the second contact point (12) is in contact with a second contact surface (26), and vice-versa, the tension strip (14) being elastically deformed and an arch of the arched section (16) being elastically deformed by linear displacement of the first and the second contact points (10, 12), respectively, over the first and the second contact surfaces (22, 26), the electric switch further comprising a holder (2) in which are arranged:

a common contact terminal (6), the contactor (8), which has the first contact point (10) on a convex side of the end area (18) and the second contact point (12) on a concave side of the end area (18), an end of the arched section (16) opposite the end area (18) is supported on the common terminal (6), the actuating element (4) which, to operate the switch, is moved from the normal position to the switching position, a first selective terminal (20) with the first contact surface (22) and a second selective terminal (24) with the second contact surface (26), such that the end area (18) of the contactor (8) is switchable back and forth between the first and the second contact surfaces (22, 26), a lever (28) with two end areas, one end area of the lever (28) being mounted to pivot around a pivot point (30), and with the tension strip (14) of the contactor (8) attached to another end area of the lever (28), which is in contact with the actuating element (4).

3. The electric switch according to claim 1, wherein the tension strip (14) is more flexible and more easily deformable than the arched section (16).

4. The electric switch according to claim 1, wherein, when the actuating element (4) is operated, the first and the second contact points (10, 12) move in a longitudinal direction of the holder over the associated first and the second contact surfaces (22, 26) before and after a connection change.

5. The electric switch according to claim 1, wherein a convex side of the arched section (16) of the contactor (8) faces either toward or away from the actuating element (4).

6. The electric switch according to claim 2, wherein a distance between the pivot point (30) of the lever (28) and the attachment point (32) of the tension strip (14) to the lever (28) is either larger or smaller than the distance between a touch-point (34; 35) of the first and the second contact points (10; 12) on the associated first and the second contact surface (22, 26) and the attachment point (32) of the tension strip (14).

7. The electric switch according to claim 1, wherein either the switch or the contactor (8) is temporarily arrested in the switched position.

8. The electric switch according to claim 1, wherein the first and the second contact points (10, 12) of the contactor (8) comprise a different material than at least one of the tension strip (14) and the arched section (16).

9. The electric switch according to claim 2, wherein the first and the second contact surfaces (22, 26) of the first and the second selective terminals (20, 24) comprise a same material as the first and the second contact points (10; 12).

10. The electric switch according to claim 2, wherein the first and the second selective terminals (20, 24) comprise a material different from that of the first and the second contact surfaces (22, 26).

11. The electric switch according to claim 2, wherein the holder (2) is a housing closed by a cover (3).

12. The electric switch according to claim 4, wherein the first and the second contact points (10; 12) are rotatable about an axis which extends parallel to the longitudinal direction of the holder.

13. The electric switch according to claim 4, wherein, when the switch is actuated, the first and the second contact points (10, 12) are essentially not rotated about an axis perpendicular to the longitudinal direction of the holder.

14. The electric switch according to claim 1, wherein one of the first and the second contact surfaces (22, 26) is not conductive and limits movement of the contactor (8).

15. An electric switch comprising:

a flexible contactor (8) having an end area (18) from which at least one tension strip (14) and at least one arched section (16) extend, the end area (18) having a first contact point (10), on one face, and a second contact point (12), on an opposite face;

a lever (28) having an attachment end and a secured end, the attachment end communicates with an end of the at least one tension strip (14) that is remote from the end area (18) of the contactor (8) and the secured end being pivotably fixed to a holder (2) at a pivot point (30), and the lever (28) extends essentially parallel to the at least one tension strip (14);

the holder (2) having a first terminal (20) with a contact surface (22) and a second terminal (24) with a contact surface (26), the first and the second terminals (20, 24) being arranged such that the contact surface (22) of the first terminal (20) is aligned with but spaced from the contact surface (26) of the second terminal (24), and the contactor (8) is arranged such that end area (18) and the first and second contact points (10, 12) being aligned between but spaced from the first and the second contact surfaces (22, 26);

the lever (28) being pivotable between a normal position, a switch-over position and a switched position and communicates with the tension strip (14) such that, in the normal position, the first contact point (10) of the contactor (8) contacts the contact surface (22) of the first terminal (20), the second contact point (12) of the contactor (8) is spaced from the contact surface (26) of the second terminal (24), and each of the first and the second contact points (10, 12) of the contactor (8) and the contact surfaces (22, 26) of the first and the second terminals (20, 24) are linearly aligned, in the switch-over position, the first contact point (10) of the contactor (8) contacts the contact surface (22) of the first terminal (20), the second contact point (12) of the contactor (8) is spaced from the contact surface (26) of the second terminal (24), and the first and the second contact points (10, 12) of the contactor (8) are linearly spaced from the contact surfaces (22, 26) of the first and the second terminals (20, 24) by a distance, in the switched position, the second contact point (12) of the contactor (8) contacts the contact surface (26) of the second terminal (24), the first contact point (10) of the contactor (8) is spaced from the contact surface (22) of the first terminal (20) and the first and the second contact points (10, 12) of the contactor (8) are linearly spaced from the contact surfaces (22, 26) of the first and the second terminals (20, 24) by a distance.

* * * * *